United States Patent [19]

Greenway

[11] Patent Number: 5,016,734

[45] Date of Patent: May 21, 1991

[54] POLE CLIMBING DEVICE

[76] Inventor: Peter Greenway, P.O. Box 242, Canmore, 0M0

[21] Appl. No.: 484,671

[22] Filed: Feb. 26, 1990

[51] Int. Cl.[5] ..... A63B 27/00

[52] U.S. Cl. ..... 182/221; 182/134

[58] Field of Search ..... 182/221, 134

[56] References Cited

U.S. PATENT DOCUMENTS

| | | | |
|---|---|---|---|
| 693,433 | 2/1902 | Owens | 182/221 |
| 1,983,526 | 12/1934 | Bailey | 182/221 |
| 2,297,136 | 9/1942 | Detering | 182/221 |
| 2,391,810 | 12/1945 | Webber | 182/221 |
| 3,297,105 | 1/1967 | Lawrence | 182/221 |
| 3,867,998 | 2/1975 | Joseph | 182/221 |
| 4,524,530 | 6/1985 | Greenway | 182/221 |

*Primary Examiner*—Reinaldo P. Machado

*Attorney, Agent, or Firm*—George Haining Dunsmuir

[57] ABSTRACT

There has been very little improvement in pole climbing devices over the past one hundred years. A relatively simple, electrically insulating pole climbing device includes a solid, one-piece sole plate for attachment to the bottom of a boot or shoe, a side bar pivotally connected to one side of the sole plate for extending upwardly therefrom and carrying a top strap for connecting the device to the calf of a user, a metal gaff mounted on the side bar for engaging a pole, and an arm extending upwardly from the other side of the sole plate and carrying straps for connecting the sole plate to the foot and ankle of the wearer. The combination electrically insulates the gaff from the wearer, so that the possibility of an electrical shock is substantially reduced.

6 Claims, 3 Drawing Sheets

POLE CLIMBING DEVICE

BACKGROUND OF THE INVENTION

This invention relates to a pole climbing device.

The device of the present invention is primarily intended for use when climbing utility poles. However, it will be appreciated that the device can also be used to climb other poles or trees.

In general, the technique of climbing poles has remained virtually unchanged for over one hundred years. It is conventional for a lineman to wear metal bars strapped to his legs and extending under the soles of his boots, the bars being equipped with gaffs for digging into the pole. The climbing action involves alternatively engaging one gaff and disengaging the other. In a work position, the pole is engaged by both gaffs, and a safety strap is wrapped around the pole to enable the lineman to work with both hands free.

Conventional pole climbing devices pose several problems, the main one being the possibility of electrical shock. The wires on many utility poles are live (carry electricity). If a lineman inadvertently touches a ground wire with the gaff and brushes against a live wire, the result can be electrocution. A second problem involves the limited support area provided by the conventional metal bar. If a lineman is required to stand for any length of time on such bars, a certain amount of discomfort and loss of circulation results. The problem is particularly severe in cold climates.

One attempt to solve the problem set out above is described in applicant's Canadian Patent No. 1,187,693, which issued on May 28, 1985. The patent describes a lineman's climbing aid including an outer boot for wearing over a standard work boot with a replaceable steel gaff connected to the outer boot. The outer boot is a one-piece molding of electrically insulating, water impermeable, plastic material. While the patented structure performs the desired function, the production of an outer boot of the type described in the patent is relatively expensive, particularly when the outer boot must be provided in a variety of sizes. Moreover, because access to the replaceable steel gaff is gained from the interior of the outer boot, gaff replacement can be somewhat difficult and time consuming.

The object of the present invention is to provide a relatively simple, electrically insulating pole climbing device, which overcomes the problems set out in the foregoing description.

BRIEF DESCRIPTION OF THE INVENTION

Accordingly, the present invention relates to a climbing device for attachment to an article of footwear to facilitate pole climbing comprising solid, electrically nonconducting sole plate means for supporting the foot of a wearer; electrically nonconducting side bar means extending upwardly from said sole plate means during use for carrying climbing gaff; pivot means for rotatably connecting said side bar means to said base plate means to facilitate movement of a wearer's foot; and coupling means for connecting said sole plate means and side bar means to the foot and leg of a user.

BRIEF DESCRIPTION OF THE DRAWINGS

The invention will be described in greater detail with reference to the accompanying drawings, which illustrate a preferred embodiment of the invention, and wherein.

DESCRIPTION OF THE PREFERRED EMBODIMENT(S)

With reference to FIGS. 1 to 4, the basic elements of the climbing device include a solid plastic sole plate generally indicated at 1, a vertical side bar 2 pivotally connected to the sole plate 1, and a calf strap 3.

Figure 1:
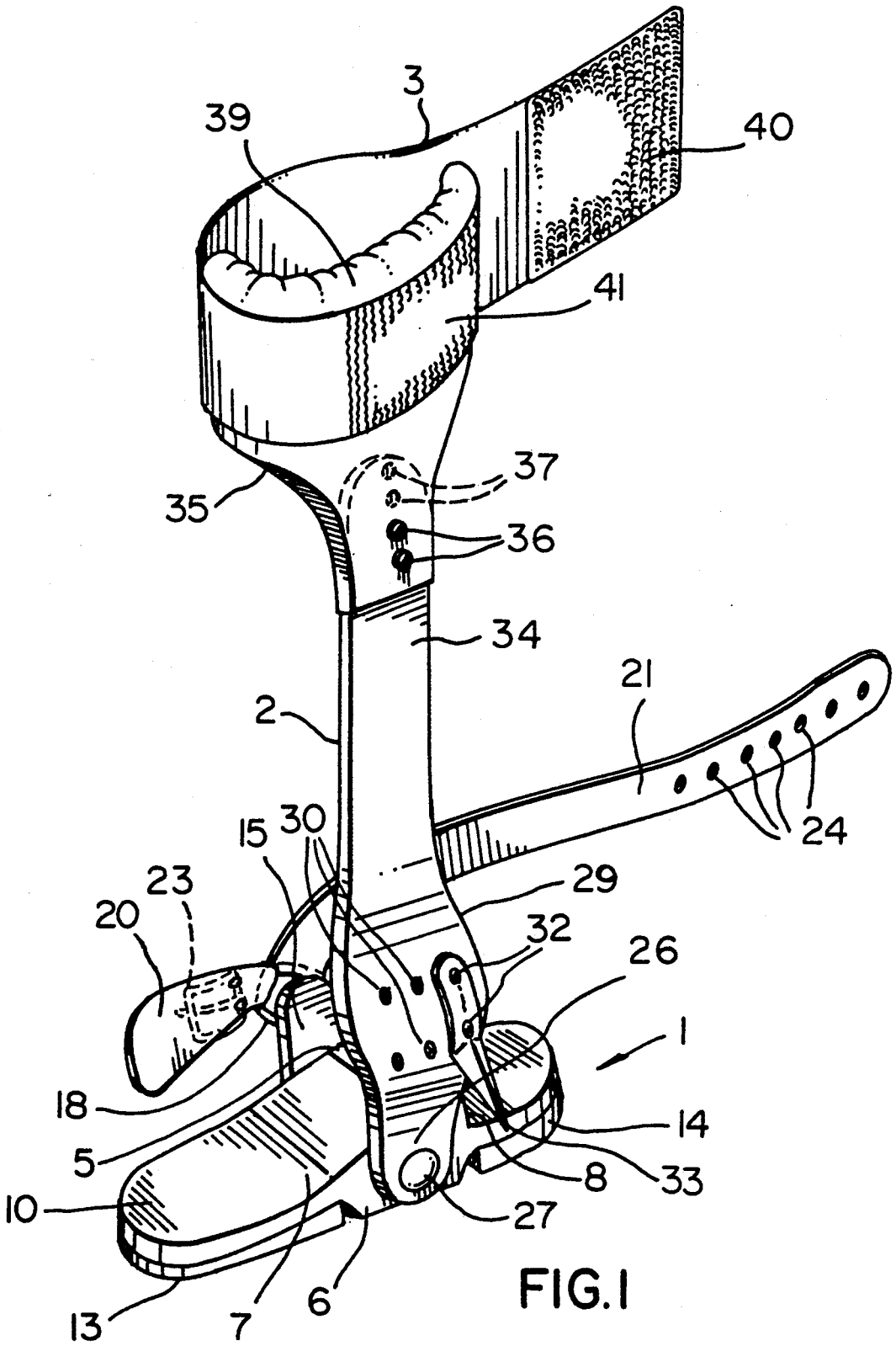
FIG. 1 is a perspective view from above and one side of a pole climbing device in accordance with the present invention.
Figure 2:
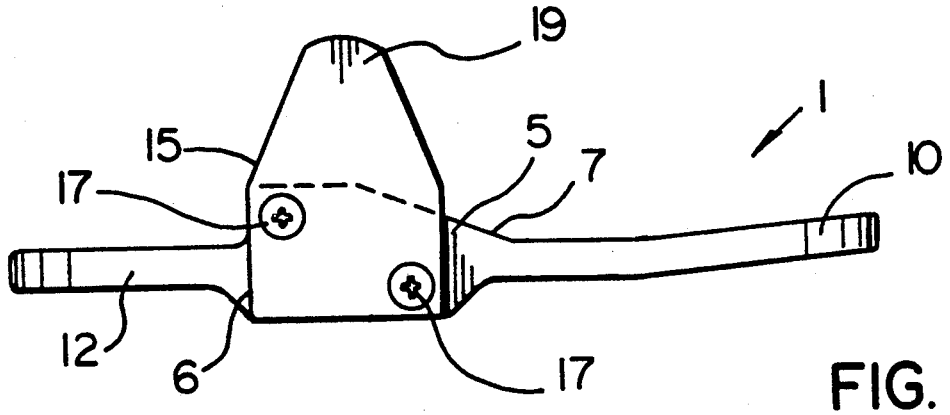
FIG. 2 is a side elevation view of a sole plate for use in the device of FIG. 1.
Figure 3:
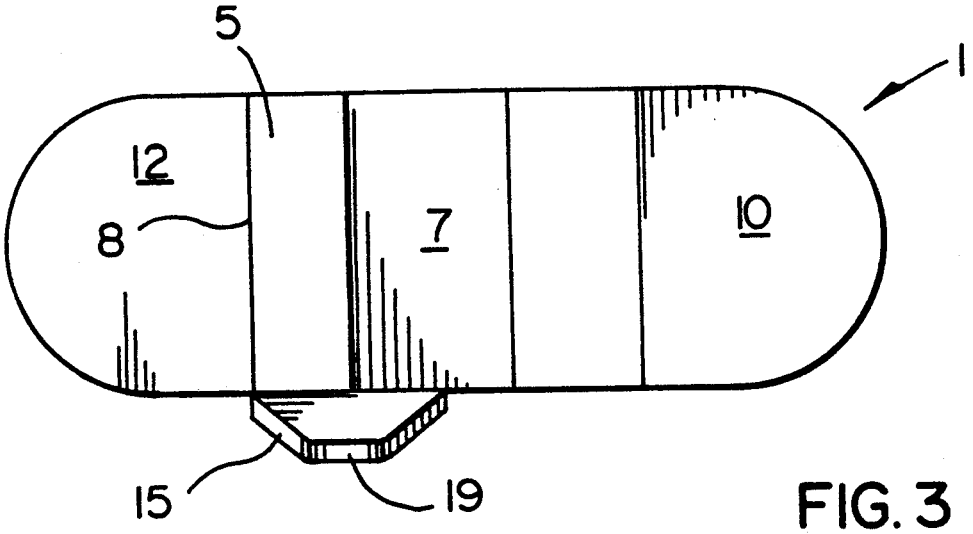
FIG. 3 is a plan view of the sole plate of FIG. 2.
Figure 4:
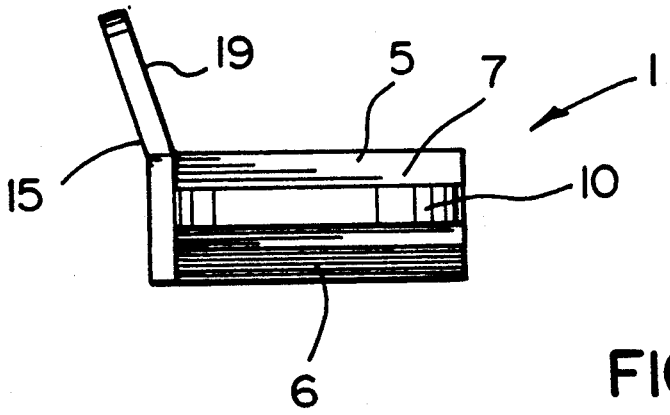
FIG. 4 is a front view of the sole plate of FIGS. 2 and 3.

As best shown in FIGS. 2 to 4, the sole plate 1 is oval when viewed from above or below and includes upper and lower instep projections 5 and 6, respectively. The upper projection 5 includes a forwardly inclined front or toe end 7 and a straight vertical rear or heel end 8. The toe portion 10 of the plate 1 is inclined slightly upwardly and the heel portion 12 is rectilinear. Thus, the shape of the top surface of the plate 1 conforms to the shape of the bottom surface of the shoe or boot of the wearer. Rubber toe and heel pads 13 and 14, respectively (FIG. 1) are attached to the base of the plate 1 in front of and behind the lower projection 6.

A plastic arm 15 extends upwardly from one side of the central instep area of the sole plate 1. The arm 15 is connected to the plate 1 by screws 17 (FIG. 2). The arm 15, which is chevron-shaped in cross section extends vertically upwardly and then outwardly to facilitate insertion of a boot or shoe into the device. A ring 18 is attached to the tapering upper end 19 of the arm 15. A pair of straps 20 and 21 are connected to the ring 18. The shorter strap 20 carries a belt buckle 23 on the outer surface thereof. A row of holes 24 are provided in the outer end of the strap 21 for connecting the latter to the buckle 23.

The side bar 2 is an elongated strip of solid plastic, the downwardly tapering bottom end 26 of which is pivotally connected by a bolt 27 to the inner side of the instep area of the sole plate 2. A wide ankle portion 29 of the side bar 2 bows outwardly so that the side bar does not press against a wearer's ankle. A plurality of pairs of vertically aligned holes 30 are provided in the ankle portion 29 for receiving screws 32, which secure a forged steel gaff 33 on the side bar 2.

The top end 34 of the side bar 2 is inserted into an arcuate calf strap holder 35. The holder 35 is retained on the side bar 2 by screws 36. Additional holes 37 are provided in top end 34 of the side bar 2 for adjusting the position of the holder 35 on the side bar 2 and consequently the length of the device. The holder 35 flares upwardly to support the padded nylon strap 3. The interior of the strap 3 includes a pad 39 of foam encased in leather mounted on the holder 35. The strap 3 extends around the leg of the wearer and is secured in position by a Velcro (trademark) fastener defined by hooks 40 on the interior surface of the outer free end of the strap 3 and a fabric strip 41 on the exterior of the inner end of the strap.

Figure 5:
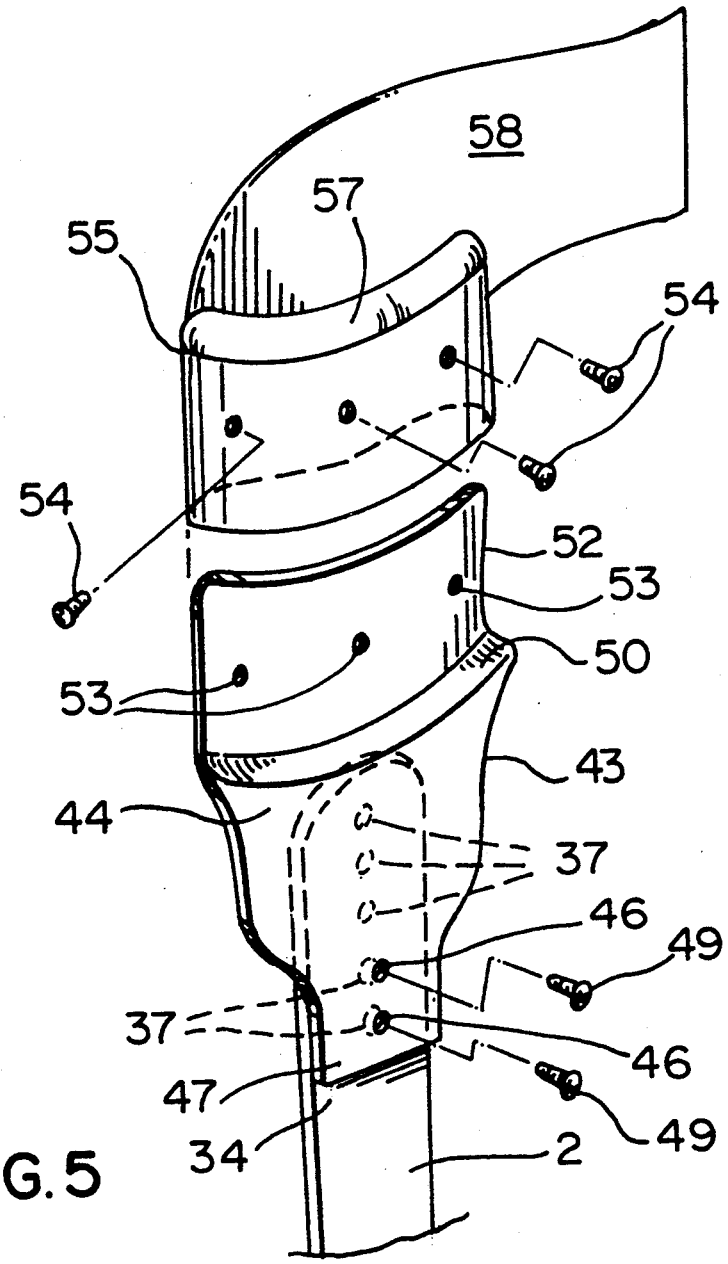
FIG. 5 is a perspective view of a portion of an alternative top end of the device of FIG. 1.

Referring to FIG. 5, an alternative strap holder 43 includes thin plastic body 44 with a pair of vertically aligned holes 46 in the lower end 47 thereof for receiving screws 49 for connecting the holder in overlapping relationship to the top end 34 of the side bar 2. A shoulder 50 is provided between the lower and upper ends 47 and 52, respectively so that the interior surface of the upper end 52 is in the same plane as the interior surface of the side bar 3. Holes 53 in the arcuate upper end 52 of the holder receive screws 54 (which may be rivets) for connecting a pad 55 in the form of a sleeve 57 carrying a belt or strap 58 similar to the strap 3.

Of course, the user will require a pair of climbing devices of the type described above. In use, the boot or shoe of the wearer is placed on the base plate 2, with the front of the heel engaging the vertical end 8 of the upper projection 5. The strap 21 is wrapped around the ankle of the wearer and connected to the buckle 23. Because of the simplicity of the structure, it is relatively easy to replace the sole plate 1 of a pair of climbing devices to suit the foot size of the wearer. The only metal in the device includes the gaff 33 and a few screws or rivets. Thus, the device as a whole is electrically nonconducting. Even if the gaff 33 contacts ground and the wearer a live wire, the wearer is in no danger of electrical shock.

What I claim is:

1. A climbing device for attachment to an article of footwear to facilitate pole climbing comprising solid, electrically nonconducting sole plate means; for supporting the foot of a wearer; said sole plate means including a top instep projection for conforming the shape of the top surface of said sole plate to the sole of the footwear article; a bottom transversely extending instep projection; and toe and heel resilient pad means defining a substantially planar bottom surface with said bottom projection; electrically nonconducting side bar means extending upwardly from said sole plate means during use for carrying climbing gaff; pivot means for rotatably connecting said side bar means to said base plate means to facilitate movement of a wearer's foot; and coupling means for connecting said sole plate means and side bar means to the foot and leg of a user.

2. A device according to claim 1, wherein said coupling means includes holder means on said side bar means; and first strap means connected to said holder means for extending around the leg of a wearer.

3. A device according to claim 2, wherein said side bar means extends upwardly from one side of said sole plate means, and said coupling means includes arm means on the other side of said plate means opposite said side bar means; and second strap means connected to said arm means for extending around the ankle of a wearer.

4. A device according to claim 2, wherein said holder means includes sleeve means for adjustably mounting said holder means on said side bar means.

5. A device according to claim 1, wherein said side bar means includes a plurality of holes in the ankle area thereof permitting adjustment of the position of the gaff on said side bar means.

6. A device according to claim 3, wherein said holder means includes sleeve means for adjustably mounting said holder means on said side bar means.

* * * * *